United States Patent [19]

Tanizawa et al.

[11] Patent Number: 5,014,484

[45] Date of Patent: May 14, 1991

[54] MODULE FOR EXPANDABLE TRUSS STRUCTURE AND EXPANDABLE TRUSS STRUCTURE EMPLOYING SAID MODULE

[75] Inventors: Kazuo Tanizawa; Jun Nakagawa, both of Kanagawa, Japan

[73] Assignee: Mitsubishi Denki Kabushiki Kaisha, Tokyo, Japan

[21] Appl. No.: 165,518

[22] Filed: Mar. 8, 1988

[30] Foreign Application Priority Data

| | | | |
|---|---|---|---|
| May 14, 1987 | [JP] | Japan | 62-117470 |
| Jul. 7, 1987 | [JP] | Japan | 62-169119 |
| Jul. 7, 1987 | [JP] | Japan | 62-169120 |
| Jul. 8, 1987 | [JP] | Japan | 62-170006 |

[51] Int. Cl.[5] ..... E04H 12/18

[52] U.S. Cl. ..... 52/646; 52/645

[58] Field of Search ..... 52/646, 645; 135/22, 135/23, 24

[56] References Cited

U.S. PATENT DOCUMENTS

| | | | |
|---|---|---|---|
| 319,225 | 6/1885 | Gilardini | 135/22 |
| 570,857 | 11/1893 | Plack | 135/22 |
| 808,863 | 1/1906 | McGuire | 135/22 |
| 2,534,710 | 12/1950 | Golian | 135/22 |
| 4,475,323 | 10/1984 | Schwartzberg | 52/646 |
| 4,532,742 | 8/1985 | Miura . | |
| 4,534,374 | 8/1985 | Day | 135/22 |
| 4,667,451 | 5/1987 | Onoda | 52/646 |

FOREIGN PATENT DOCUMENTS

| | | | |
|---|---|---|---|
| 1900443 | 7/1970 | Fed. Rep. of Germany | 135/22 |
| 18418 | of 1894 | United Kingdom | 135/22 |

OTHER PUBLICATIONS

John A. Fager & Ray Garriott, "Large Aperture Expandable Truss Microwave Antenna", 1969.

W. Schneider, "Space Station Structures", 1984.

*Primary Examiner*—Henry E. Raduazo

*Attorney, Agent, or Firm*—Wolf, Greenfield & Sacks

[57] ABSTRACT

A module for an expandable truss structure which defines one unit of the structure and which is capable of being transformed from a folded state to a deployed state is disclosed. A wire is tensely stretched between each pair of adjacent vertices of each tetrahedral module when the truss structure is deployed to thereby eliminate looseness from the joints of the constituent members. Accordingly, it is possible to obtain high rigidity with ease. Further, synchronous beams for effecting synchronous deployment and a compression spring for supplying energy for deployment are incorporated to allow reliable deployment to be achieved and also to enable the truss structure to be deployed without the aid of any external force. Also disclosed is an expandable truss structure composed of a plurality of interconnected expandable truss structure modules of the type described above.

35 Claims, 18 Drawing Sheets

MODULE FOR EXPANDABLE TRUSS STRUCTURE AND EXPANDABLE TRUSS STRUCTURE EMPLOYING SAID MODULE

BACKGROUND OF THE INVENTION

The present invention relates to a lightweight expandable truss structure having high packaging density.

As a result of recent developments in the performance and reliability of launch vehicles such as the space shuttle, Ariane and other types of rocket, space development has become economically feasible. In particular, large-sized expandable antenna systems are essential to telecommunications systems for moving objects such as space craft and vehicles and therefore various expandable truss structures for such antenna systems have been actively developed. In regard to scientific applications also, it has become an important issue to develop an expandable truss structure which may be used as the basic structure for a gigantic space station of the type which is being planned. This is because the expandable truss structure system is considered to be the one most suitable for allowing a huge structure to be constructed in space with optimum economy.

Prior arts of the above-described expandable truss structure will be described hereinunder.

FIG. 1 shows a conventional expandable truss structure disclosed in the U.S. scientific journal, "IEE TRANSACTIONS ON ANTENNAS AND PROPAGATION", Vol. AP-17, No. 4 (1969). In the figure, reference numeral 1 denotes folding members which constitute triangular lattice structures defining the top and bottom surfaces of the truss structure and each of which is foldable at its center, 2 diagonal members which support the triangular lattice structures of the top and bottom surfaces, and 3 couplers which pin together the folding members l and the diagonal members 2. Referring to FIG. 2, which is an enlarged view of the portion A which is enclosed by the broken line circle in FIG. 1, reference numeral 4 denotes webs which are provided on the periphery of each coupler 3 for pinning the folding and diagonal members 1, 2 to the coupler 3.

FIG. 3 is an enlarged view of the portion B which is enclosed by the broken line circle in FIG. 1, which shows in detail the central foldable portion of each folding member 1. In the figure, reference numeral 5 denotes a pivotal hinged lever consisting of two plates which are pinned together at the center of the hinged lever 5, 6 a spiral spring which is attached to one joint of the hinged lever 5 to bias the hinged lever 5 such as to pivot in the direction in which the folding member 1 is unfolded, and 7 connecting pins for connecting together the folding member 1 and the hinged lever 5, in which numerals *7a* and *7b* denote pins for connecting the hinged lever 5 and the folding member 1, and *7c* a connecting pin which connects together the two split portions of the folding member 1 at its center.

The above-described structure is also known as a tetrahedral truss structure since it comprises a plurality of tetrahedral modules which are connected together in one unit, each tetrahedral module consisting of three folding members 3, three diagonal members 2 and four couplers 3. FIG. 4 shows the above-described expandable truss structure as deployed.

Deployment of the above-described expandable truss structure will next be explained.

The structure which is restrained in a packaged configuration by a retaining cable (not shown) is made movable when the retaining cable is cut by means of, for example, a detonating fuse, which is detonated in response to a command given from the ground, and the structure begins to be deployed by means of the resilient forces of the spiral springs 6. More specifically, the hinged lever 5 is pivoted by means of the force of the spiral spring 6, thereby expanding the folding member 1 while unfolding it about the connecting pin *7c*. As the folding members 1 are unfolded, the couplers 3 on the top and bottom surfaces are spread radially and, in this way, deployment of the expandable truss structure progresses. When the folding member 1 has expanded in a straight line, the torque generated through the hinged lever 5 by the resilient force from the spiral spring 6 and the contact surface pressure at the abutting surfaces of the folding member 11 balance each other, and the motion of the folding member 1 stops. Thus the expandable truss structure is deployed with a configuration which consists only of interconnected triangular lattices. The triangular lattice structure is basically rigid and stable and therefore expandable truss structures of the type described above have heretofore been considered to be exceedingly rigid and hence appropriate to expandable antenna systems or structural objects for use in space stations However, the fact of the matter is that the conventional expandable truss structure is non-rigid and incapable of retaining even its own deployed configuration because the associated members are not connected together at one point. More specifically, the triangular lattice structure is rigid only when the associated members are connected together at one point as shown in FIG. 5. In the conventional structure, however, the triangular lattice structure has a large number of hinged nodes as shown in FIG. 6 and therefore fails to possess adequate rigidity, resulting in an unstable link structure. It should be noted that, in FIGS. 5 and 6, reference numeral 8 denotes basic members which constitute a triangular lattice structure, 9 pin joints for connecting together the basic members 8, and 3 couplers which connect together the basic members 8 by means of the pin joints 9.

As described above, the conventional expandable truss structure that employs folding members is basically unstable and therefore incapable of exhibiting adequate rigidity for expandable antenna systems or space station main body structures.

SUMMARY OF THE INVENTION

It is an object of the present invention to provide a module for an expandable truss structure which is capable of being transformed from a folded state to a deployed state, and an expandable truss structure employing this module.

It is another object of the present invention to provide a module for an expandable truss structure which exhibits high structural stability and high rigidity in a deployed state, and an expandable truss structure employing this module.

It is still another object of the present invention to provide a module for an expandable truss structure which is light in weight and is able to be folded into a compact size and readily deployed, and an expandable truss structure employing this module.

It is a further object of the present invention to provide a module for an expandable truss structure which is easy to produce and assemble, and an expandable truss structure employing this module.

To these ends, the present invention provides a module for an expandable truss structure which defines one unit of the structure and which is capable of being transformed from a folded state to a deployed state, the module comprising: a stem; a first coupler secured to one end of the stem and having a pin joint portion; a slide hinge slidably mounted on the stem, the slide hinge being movable in the axial direction of the stem; at least three ribs each pinned at one end thereof to the slide hinge, the ribs being deployable radially about the axis of the stem; a second coupler pinned to the other end of each of the ribs and having a pin joint portion; slide hinge lock means for stopping and locking the slide hinge at a predetermined position on the stem when the module is deployed; an intermediate member for connecting the pin joint portion of the first coupler and the pin joint portion of each of the second couplers, the intermediate member having a length sufficient to stop the corresponding rib so that the corresponding rib extends substantially at right angles to the stem when the, module is deployed; and a tension member provided between each pair of adjacent second couplers in such a manner that the tension member is tensely stretched between the pair of second couplers when the module is deployed.

The expandable truss structure that employs modules having the arrangement described above comprises a plurality of the above-described modules connected together, wherein each pair of adjacent modules have their respective stems extending parallel to each other in opposite directions, said first coupler of one of the pair of modules being defined by a coupler which also serves as one of said second couplers of the other module.

The module for an expandable truss structure according to the present invention may adopt the following arrangement.

Namely, according to another aspect of the present invention, there is provided a module for an expandable truss structure which defines one unit of the structure and which is capable of being transformed from a folded state to a deployed state, the module comprising: a stem; a first coupler secured to one end of the stem and having a pin joint portion; a second coupler secured to the other end of the stem and having a pin joint portion; at least three ribs each pinned at one end thereof to the second coupler, the ribs being deployable radially about the axis of the stem; a third coupler pinned to the other end of each of the ribs and having a pin joint portion; an intermediate member for connecting the pin joint portion of the first coupler and the pin joint portion of each of the third couplers, the tension member having a length sufficient to stop the corresponding rib so that the corresponding rib extends substantially at right angles to the stem when the module is deployed; a tension member connecting together each pair of adjacent third couplers, the tension member being tensely stretched between the pair of third couplers when the module is deployed; and rib deploying means for applying deploying force to the ribs.

The expandable truss structure that employs the second type of module having the arrangement described above comprises a plurality of modules of the second type which are connected together, wherein each pair of adjacent modules have their respective stems extending parallel to each other in opposite directions, said first coupler of one of the pair of modules being defined by a coupler which also serves as one of said third couplers of the other module.

The foregoing objects, other objects and the specific construction and operations of the present invention will become more apparent and readily understandable from the following detailed description of a few preferred embodiments thereof, when read in conjunction with the accompanying drawings

DESCRIPTION OF THE PREFERRED EMBODIMENTS

The present invention will be described hereinunder in detail with reference to the accompanying drawings.

Figure 1:
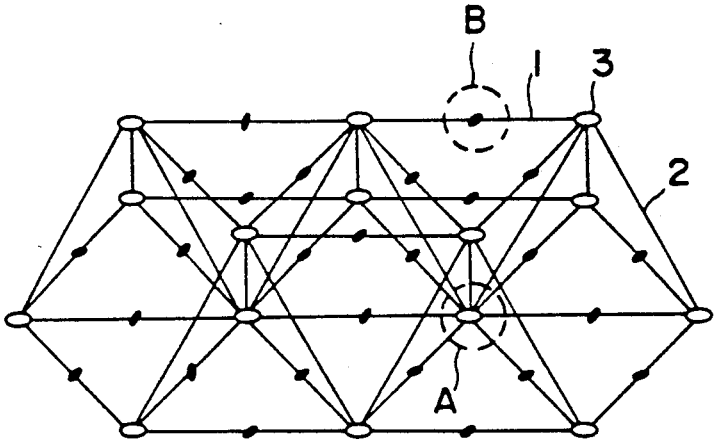
Fig. 1 PRIOR ART
FIG. 1 shows a prior art in a deployed state.
Figure 2:
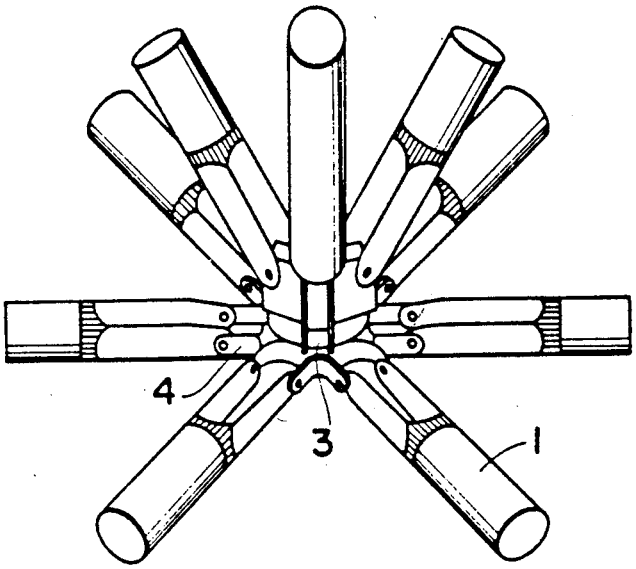
Fig. 2 PRIOR ART
FIG. 2 shows a joint of the diagonal members of the prior art.
Figure 3:
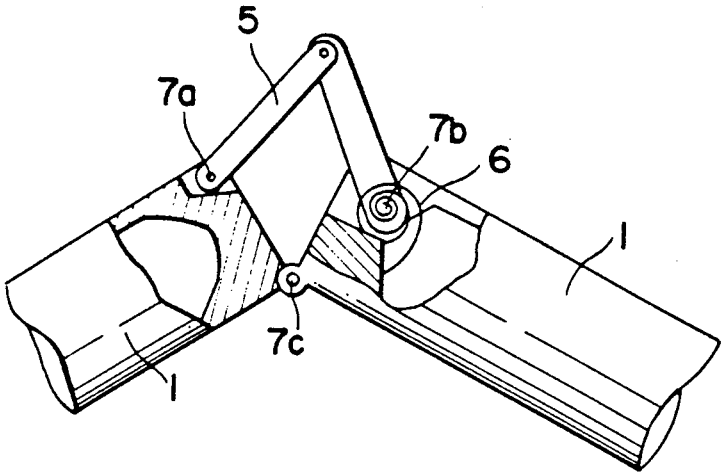
Fig. 3 PRIOR ART
FIG. 3 shows the mechanism of one folding member constituting a triangular lattice structure in the prior art.
Figure 4:
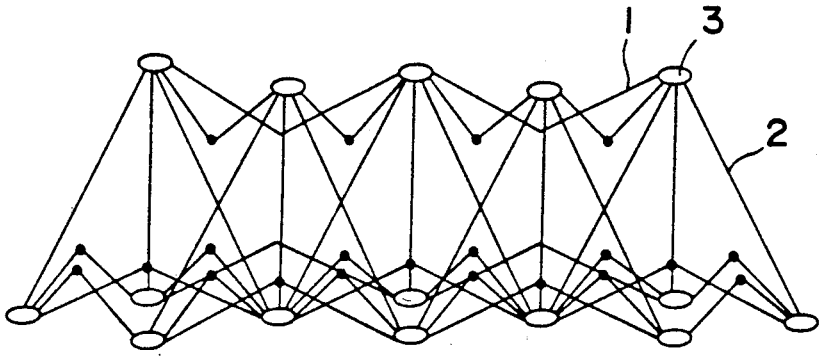
Fig. 4 PRIOR ART
FIG. 4 shows the prior art as deployed.
Figure 5:
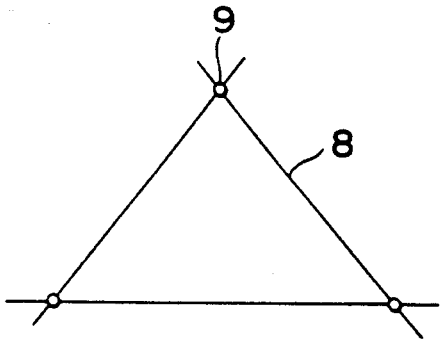
Fig. 5 PRIOR ART
FIG. 5 shows a conventionally expected physical model of the triangular lattice structure in the prior art.
Figure 6:
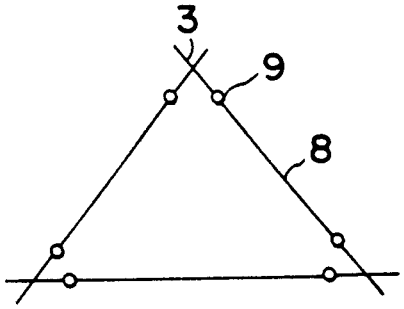
Fig. 6 PRIOR ART
FIG. 6 shows an actual physical model of the triangular lattice structure in the prior art.
Figure 7:
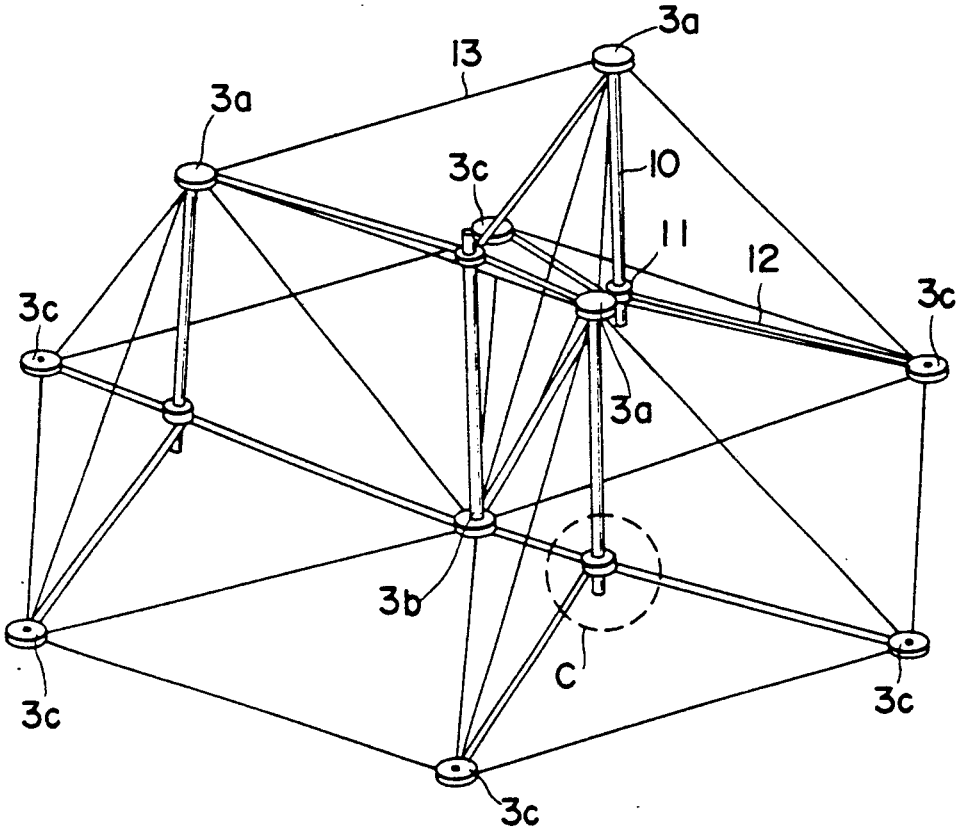
FIG. 7 schematically shows an expandable truss structure according, to a first embodiment of the present invention, the structure being in a deployed state.

Referring first to FIG. 7, which shows an expandable truss structure according to a first embodiment of the present invention in a deployed state, reference numerals 3*a*, 3*b* denote first couplers each having a pin joint portion, 3c second couplers which are respectively secured to ends of ribs, which ends define free ends of the expandable truss structure, 10 stems each having a coupler 3a secured to one end thereof, and each pair of adjacent stems 10 being disposed in such a manner that their axes extend in opposite directions. The numeral 11 denotes a main slide hinge which slides on each stem 10, and 12 ribs pinned at first ends thereof to the main slide hinge 11 so as to extend radially therefrom, the ribs 12 being deployable at right angles to the axis of the stem 10, and the second end of each rib 12 being pinned to a first coupler 3b which is secured to an adjacent inverted stem 10 in an inverted relationship with the first coupler 3a on said stem 10. Those ends of the ribs 12 which define free ends of the expandable truss structure are connected to the second couplers 3c, respectively.

The numeral 13 denotes wires which are disposed between the first couplers 3a, 3b that are secured to the ends of the stems 10, between the second couplers 3c disposed at the free ends of the expandable truss structure and between the first and second couplers 3a, 3b and 3c, the wires 13 being set so that they are pulled when the expandable truss structure is deployed.

Figure 8:
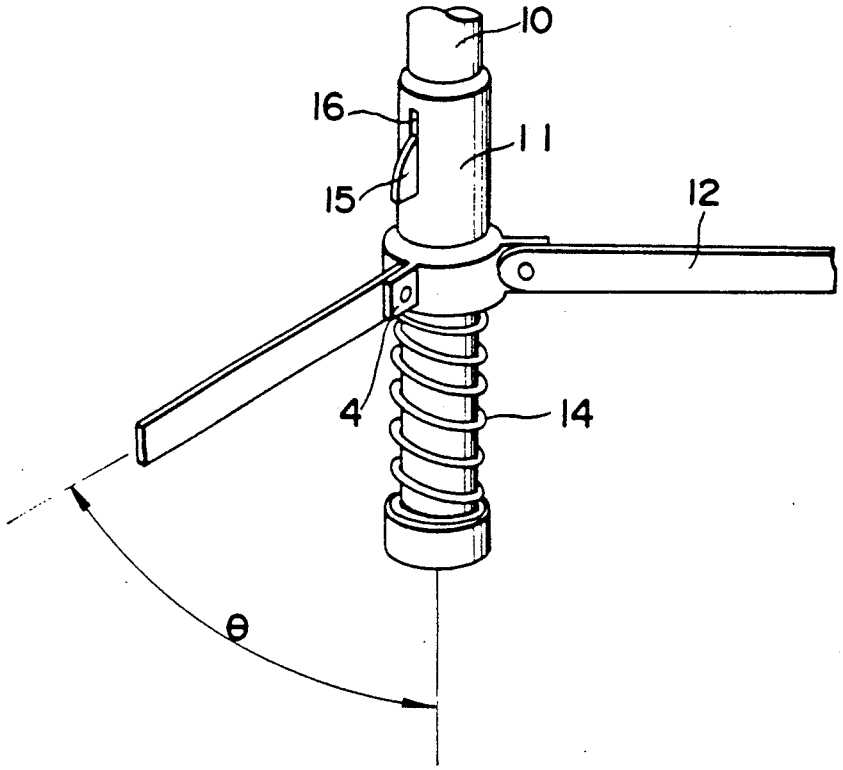
FIG. 8 shows the joint of the members in the first embodiment of the present invention.

Referring next to FIG. 8, which is an enlarged view of the portion C of FIG. 7, the reference numeral 14 denotes a stopper defined by a coil spring which is provided on the other or second end of the stem 10, and 15 a lock pin which is provided at a position on the stem 10 where the min slide hinge 11 is to be looked, the lock pin 15 being biased to project outward from the stem 10 by a spring (not shown) which is interposed between the inside of the stem 10 and the lock pin 15 so that the lock pin 15 engages with a pin groove 16 provided in the main slide hinge 11. In the figure, $\theta$ is the angle between the stem 11 and each rib 12 the angle $\theta$ being set so as to be about 90° when the expandable truss structure is deployed.

Figure 9:
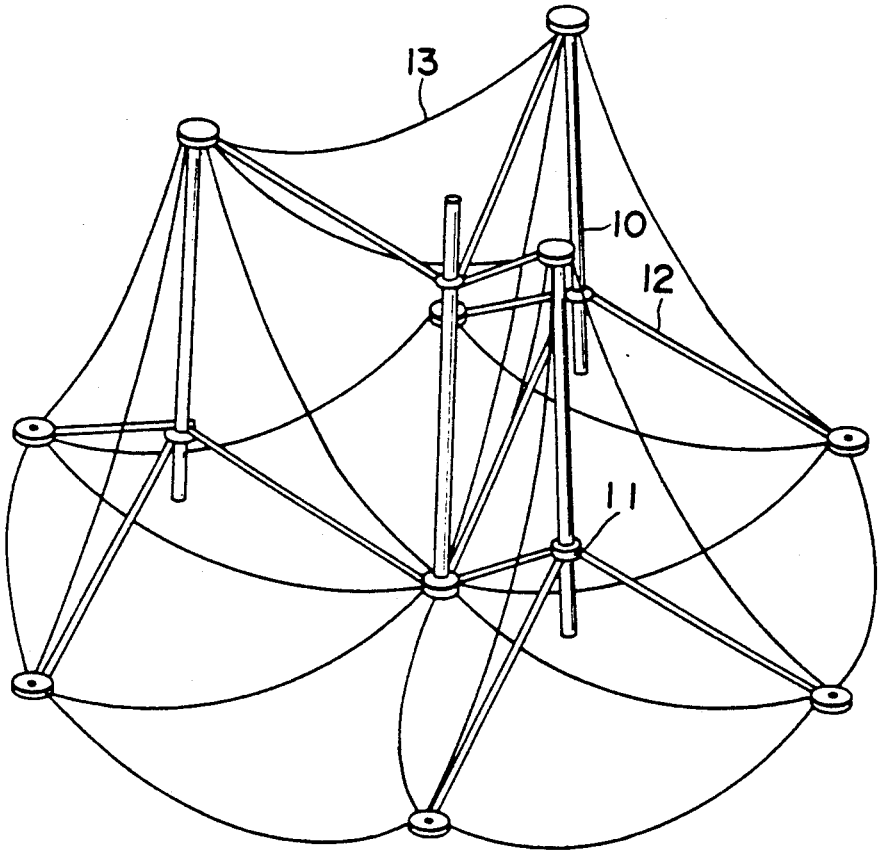
FIG. 9 shows the first embodiment of the present invention as deployed.

FIG. 9 shows the expandable truss structure according to the first embodiment as deployed.

Deployment of the expandable truss structure according to the first embodiment of the present invention arranged as detailed above will next be explained.

When this expandable truss structure is in a packaged state, the triangle which is defined by the following three vertices when the structure is deployed, i.e., a first coupler on a stem 10, for example, a coupler 3a, the main slide hinge 11 on the stem 10 and another coupler, for example, a coupler 3b, connected to the second end of a rib 12 which is pinned at its first end to the main slide hinge 11, is deformed, and the angle $\theta$ between the rib 12 and the stem 10 shown in FIG. 8 is zero. However, when the main slide hinge 11 is moved toward the lock position where the lock mechanism is provided, the distance from the coupler 3a to the main slide hinge 11 increases, whereas the distance from the coupler 3a to the other coupler 3b is maintained within a predetermined length by means of the wire 13. Since the distance from the coupler 3b to the main slide hinge 11 is also maintained at an amount equivalent to the length of the rib 12, the triangle that is defined by the above-described three vertices is formed, and the angle $\theta$ between the rib 12 and the stem 10 increases. As a result, the distance from the coupler 3b to a still further coupler, for example, a coupler 3c, which is provided at the second end of another rib 12 pinned at its first end to the above-described main slide hinge 11 also increases. When the main slide hinge 11 reaches a predetermined lock position, the wires 13 extending between the couplers 3a and 3b and those between the couplers 3b and 3c are tensely stretched. At the same time, the lock pin 15 provided on the stem 10 engages with the pin groove 16 provided in the main slide hinge 11, and the main slide hinge 11 abuts against the stopper 14. The main slide hinge 11 receives counterforce from the stopper 14 and is thereby pressed against the lock pin 15. Thus, the expandable truss structure is maintained in the deployed configuration. As described above, after the expandable truss structure has been deployed, tension is applied to the wires 13, and compressive force which equilibrates this tension is applied to the stem 10 and the ribs 12. Thus, equilibrium of forces is attained and the expandable truss structure hence becomes highly stable and rigid.

Figure 10:
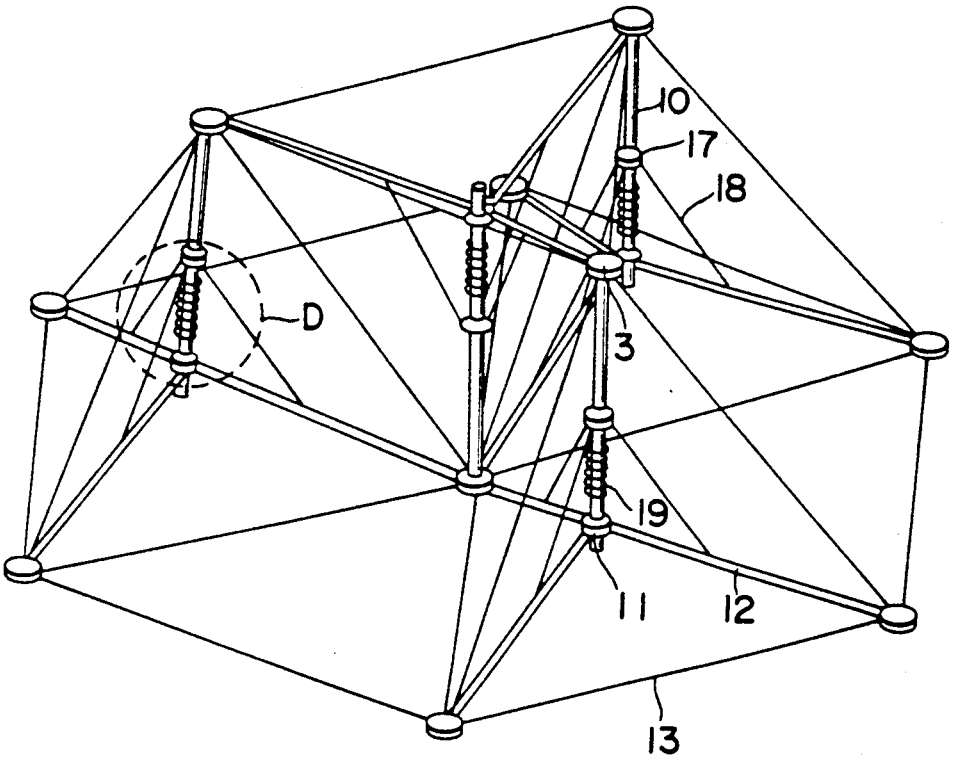
FIG. 10 schematically shows an expandable truss structure according to a second embodiment of the present invention, the structure being in a deployed state.
Figure 11:
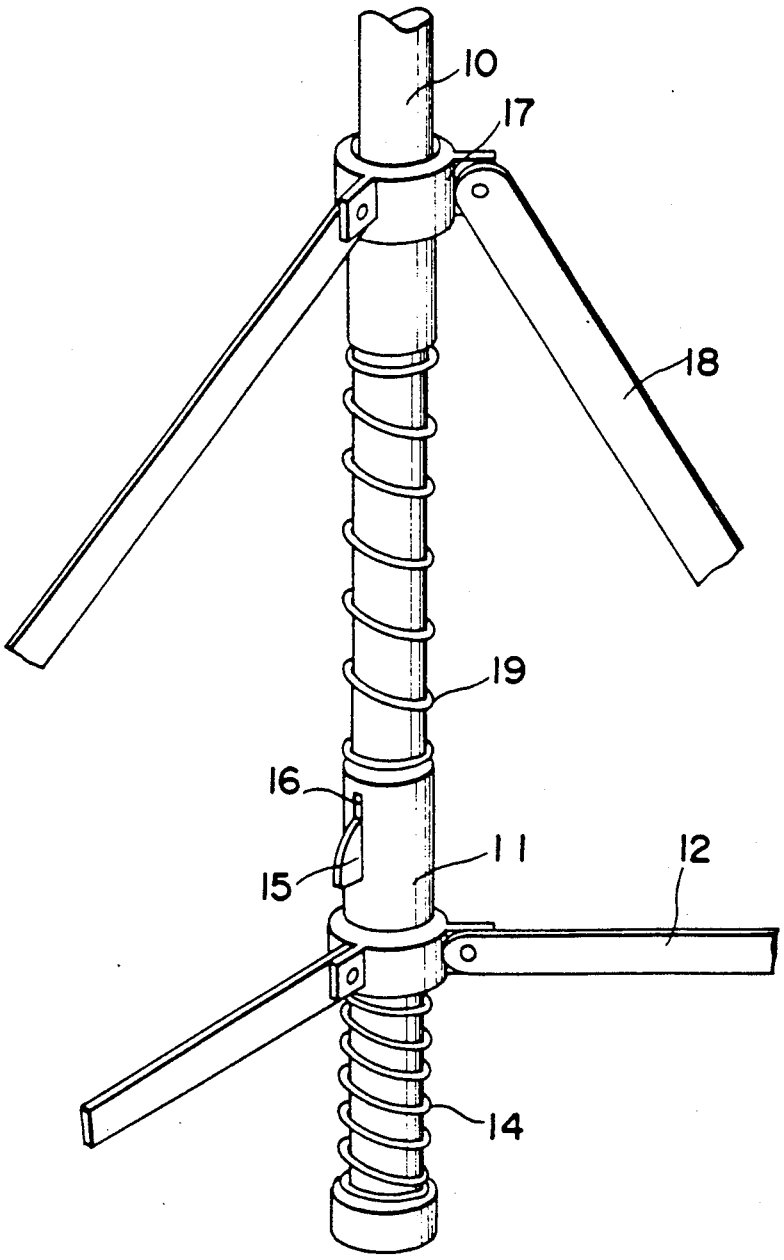
FIG. 11 shows the joints of the members in the second embodiment of the present invention.
Figure 12:
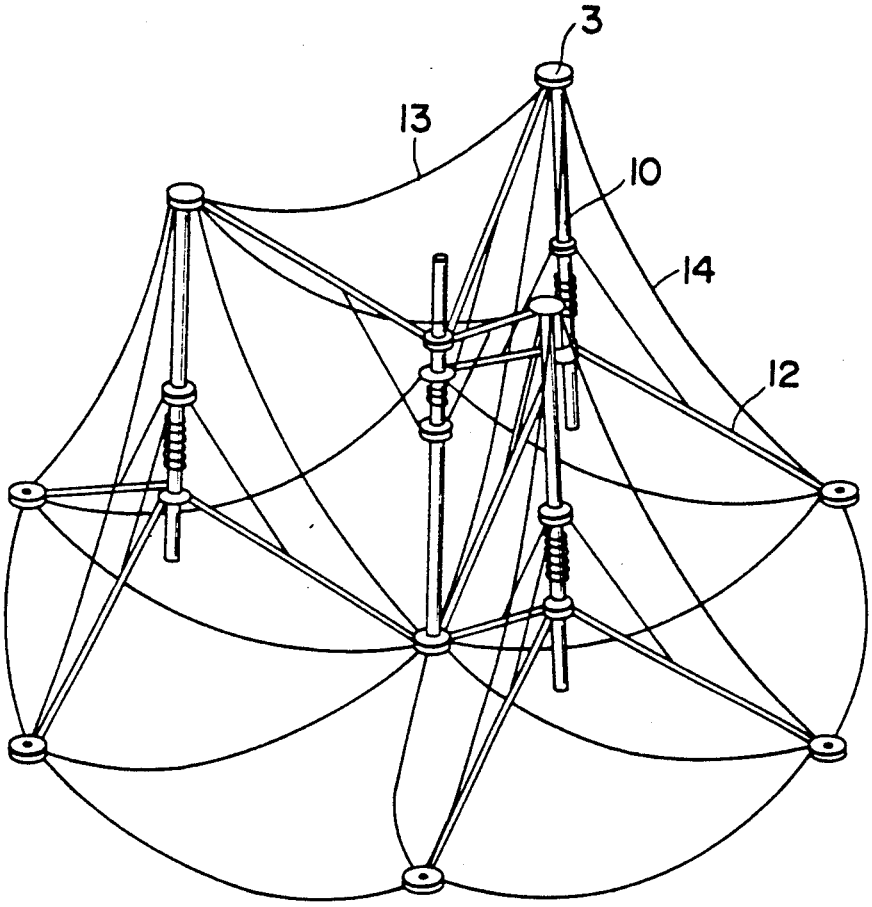
FIG. 12 shows the second embodiment of the present invention as deployed; .

Referring next to FIG. 10, which shows an expandable truss structure according to a second embodiment of the present invention in a deployed state, reference numeral 17 denotes a synchronous slide hinge which slides on each stem 10 between the coupler 3 and the main slide hinge 11, and 18 a synchronous beam which is pinned at one end thereof to the synchronous slide hinge 17 and at the other end to an intermediate portion of each rib 12. FIG. 11 is an enlarged view of the portion D of FIG. 10, in which reference numeral 19 denotes a compression spring. FIG. 12 shows the expandable truss structure according to the second embodiment as deployed. In FIGS. 10 to 12, reference numerals 3 and 10 to 16 denote the same elements as those with these reference numerals shown in FIGS. 7 to 9.

In the expandable truss structure according to the second embodiment of the present invention arranged as described above, deployment is effected by strain energy derived from the compression spring 19 which is compressed between the synchronous slide hinge 17 and the main slide hinge 11 when the structure is in a packaged state, and the deployment of the ribs 12 are synchronized by means of the synchronous beams 18. Accordingly, this expandable truss structure has the advantages that no external energy is needed for deployment and highly reliable deployment is possible without fear of the wires 13 becoming entangled with each other, which phenomenon is likely to occur in the case of a synchronous deployment.

Thus, according to the first and second embodiments of the present invention, it is possible to obtain high rigidity with ease since the wires are stretched between the vertices of each tetrahedral module to construct a rigid structure which possesses no looseness.

In the second embodiment of the present invention, synchronous beams for effecting synchronous deployment and a compression spring which supplies energy for deployment are incorporated between each stem and the associated ribs. Therefore, reliability in deployment is enhanced and deployment is attained without the aid of external force.

Figure 13:
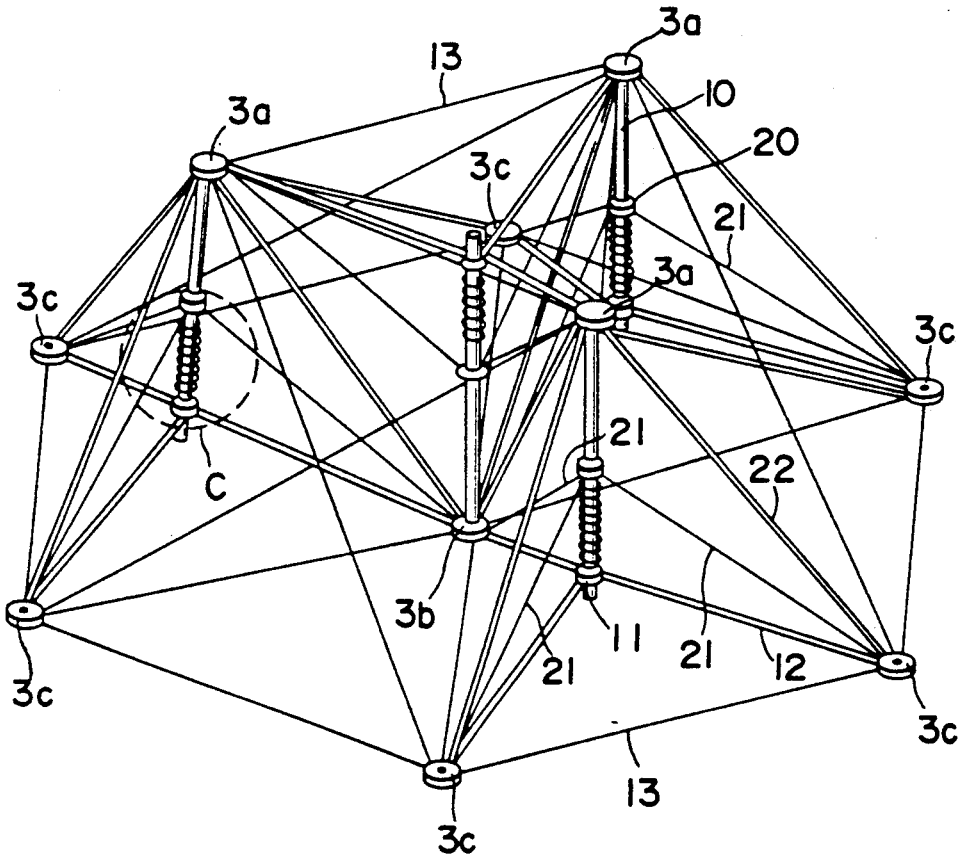
FIG. 13 schematically shows an expandable truss structure according to a third embodiment of the present invention, the structure being in a deployed state.

FIG. 13 shows an expandable truss structure according to a third embodiment of the present invention which is in a deployed state. In the figure, reference numerals 3a and 3b denote first couplers each having a pin joint portion, 3c second couplers which are respectively secured to those ends of the ribs provided which define free ends of the expandable truss structure, and 10 stems each having a coupler 3a secured to one end thereof, each pair of adjacent stems 10 being disposed in such a manner that their axes extend in opposite directions. Numeral 11 denotes a main slide hinge which slides on each stem 10, and 12 ribs pinned at first ends thereof to the main slide hinge 11 such as to extend radially therefrom, the ribs 12 being deployable at right angles to the axis of the stem 10, and the second end of each rib 12 being pinned to a first coupler 3b which is secured to an adjacent inverted stem 10 in an inverted relationship with the first coupler 3a on said stem 10. Those ends of the ribs 12 which define free ends of the expandable truss structure are connected to the second couplers 3c, respectively.

The numeral 13 denotes wires which are disposed between the first couplers 3a, 3b that are secured to the ends of the stems 10, between the second couplers 3c disposed at the free ends of the expandable truss structure, and between the first and second couplers 3a and 3c, the wires 13 being set so that they are pulled when the expandable truss structure is deployed.

Figure 14:
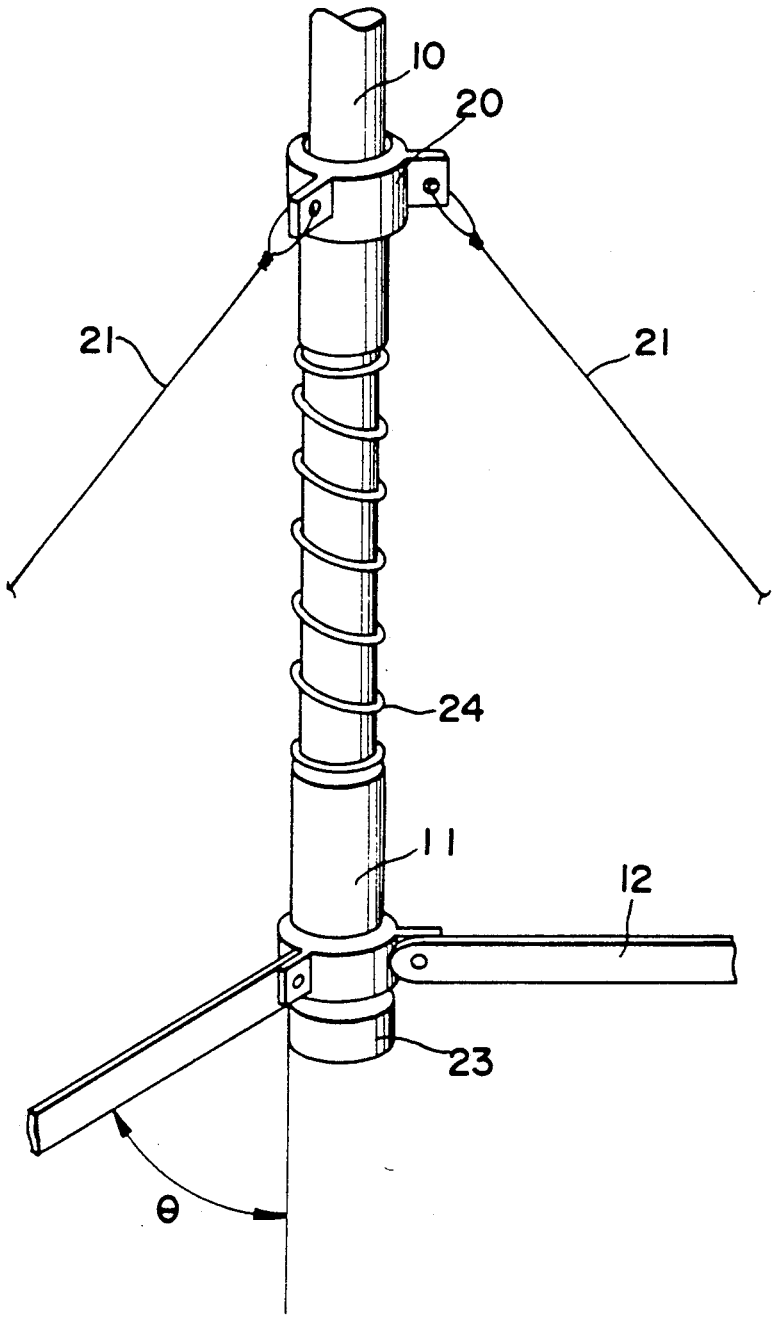
FIG. 14 shows the joints of the members in the third embodiment of the present invention.

The reference numeral 20 denotes a synchronous slide hinge which slides on each stem 10 between the coupler 3a and the main slide hinge 11, and 21 a synchronous cable which is connected at one end thereof to the synchronous slide hinge 20 and at the other end to a coupler 3a provided on a stem 10 which is disposed adjacent and in an inverted relationship with said stem 10. It should be noted that numeral 22 denotes diagonal members connecting together the couplers 3a on the top surface side and the couplers 3b, 3c on the bottom surface side by means of pins. FIG. 14 is an enlarged view of the portion C of FIG. 13, in which reference numeral 23 denotes a stopper which defines the bottom dead point of the main slide hinge 11 when the structure is deployed, 24 a coil spring which provides driving force for deploying the expandable truss structure according to the present invention, $\theta$ is the angle between the stem 11 and each rib 12 the angle $\theta$ being set so as to be about 90° when the expandable truss structure is deployed.

Deployment of the expandable truss structure according to the third embodiment of the present invention arranged as detailed above will next be explained.

When this expandable truss structure is in a packaged state, the triangle which is defined by the following three vertices when the structure is deployed, i.e., a coupler on a stem 10, for example, a coupler 3a the main slide hinge 11 on the stem 10 and another coupler, for example, a coupler 3b, connected to the second end of a rib 12 which is pinned at its first end to the main slide hinge 11, is deformed, and the angle $\theta$ between the rib 12 and the stem 10 shown in FIG. 14 is zero. Deployment is effected by pushing the main slide hinge 11 and the synchronous slide hinge 20 away from each other by means of the resilient force of the coil spring 24. As the distance from the main slide hinge 11 to the synchronous slide hinge 20 increases, the distance from the coupler 3a on the stem 10 to the main slide hinge 11 increases. However, the distance from the coupler 3a to the coupler 3b is maintained at a predetermined length by means of the diagonal member 22. Since the distance from the coupler 3b to the main slide hinge 11 is also maintained at an amount equivalent to the length of the rib 12, the triangle that is defined by the above-described three vertices is deployed, and the angel $\theta$ between the rib 12 and the stem 10 increases. As a result, the distance from the coupler 3b to a still further coupler, for example, a coupler 3c, which is provided at the second end of another rib 12 pinned at its first end to the above-described main slide hinge 11 also increases. When the main slide hinge 11 comes hear the stopper 23, the wires 13 extending between the couplers 3a on the top surface side, between the couplers 3b, 3c on the bottom surface side and between the couplers 3a at the free ends of the top surface and the couplers 3c at the free ends of the bottom surface are tensely stretched. The wires 13 are continuously stretched out until the main slide hinge 11 abuts against the stopper 23. Since the wires 13 thus stretched cause the couplers 3a, 3b and 3c to be pressed toward the ribs 12, there is no looseness of the pin joints, and therefore the expandable truss structure becomes highly rigid. Since the synchronous cables 21 have equal lengths, the ribs 12 which are deployed through the synchronous cables 21 have equal angles of deployment. Thus, synchronous deployment is attained.

Figure 15:
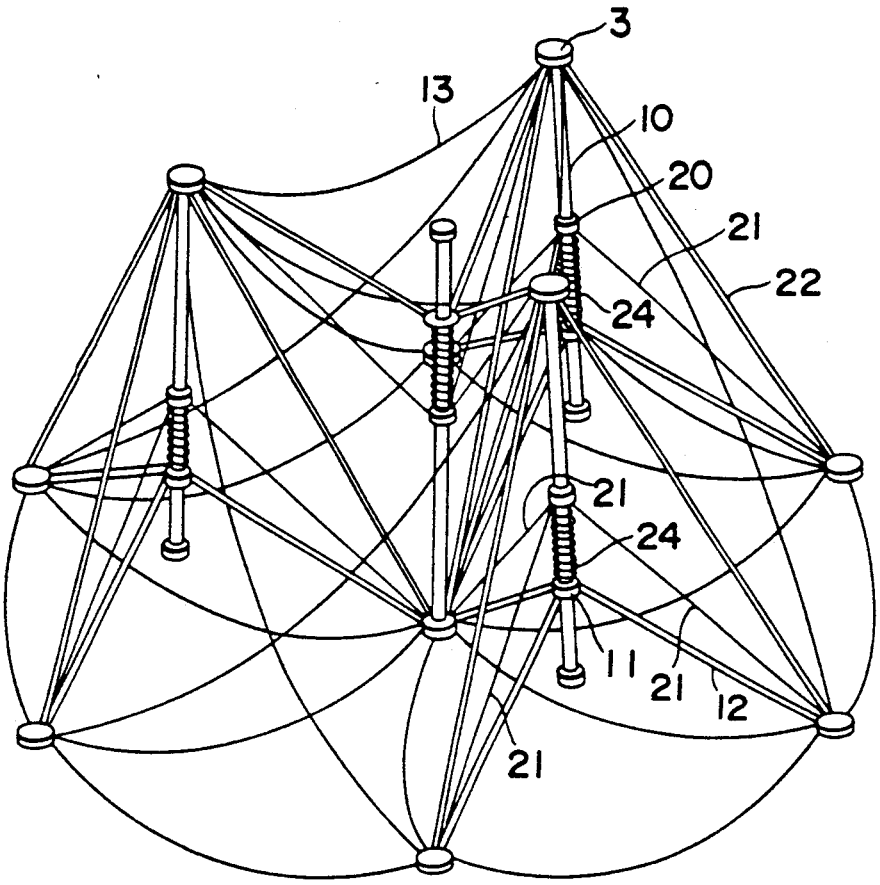
FIG. 15 shows the third embodiment of the present invention as deployed.

FIG. 15 shows the expandable truss structure according to the third embodiment of the present invention which is being deployed.

Thus, according to the third embodiment of the present invention, it is possible to obtain high rigidity with ease since the wires are stretched between the vertices of each tetrahedral module to construct a rigid structure which is free from looseness.

In the third embodiment of the present invention, synchronous cables for effecting synchronous deployment and a coil spring for supplying energy for deployment are incorporated between each stem and the associated ribs. Therefore, reliability in deployment is enhanced and deployment is attained without the aid of external force. Further, since the forces from the synchronous cables act on the couplers, no bending moment is generated in the ribs, and it is therefore possible to achieve a reduction in the weight of the ribs.

Figure 16:
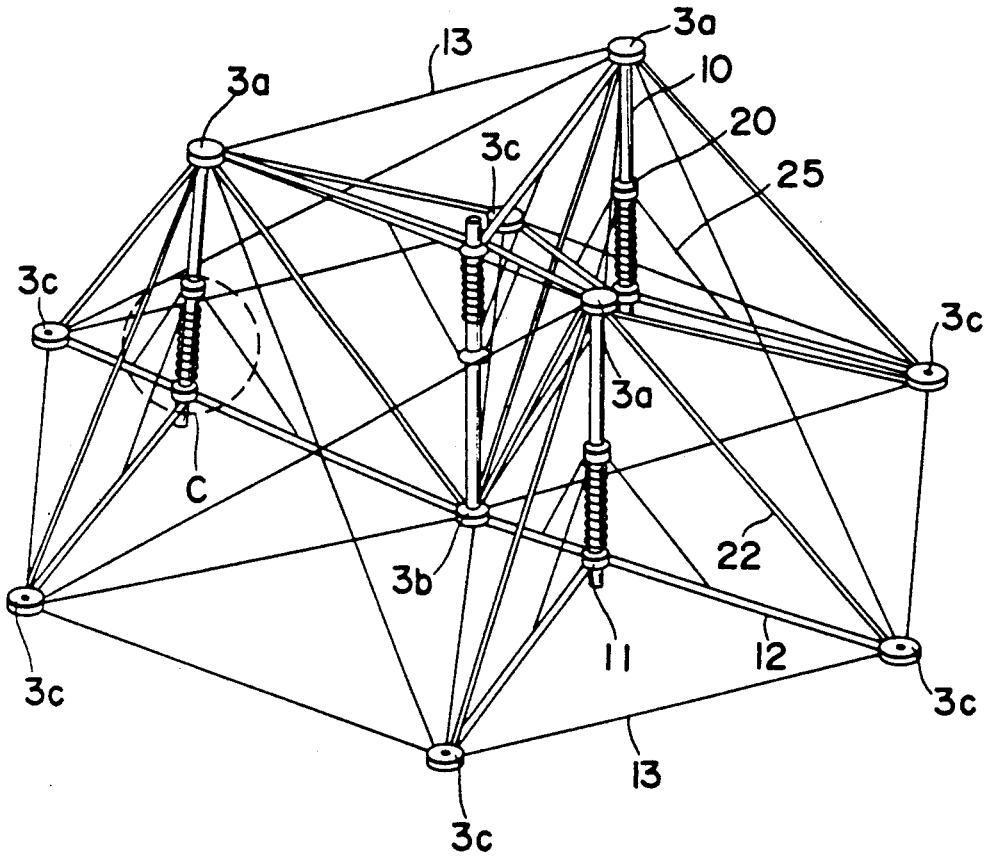
FIG. 16 schematically shows an expandable truss structure according to a embodiment of the present invention, the structure being in a deployed state.

FIG. 16 shows an expandable truss structure according to a fourth embodiment of the present invention which is in a deployed state. In the figure, the reference numerals 3a and 3b denote first couplers each having a pin joint portion, 3c second couplers which are respectively secured to those ends of ribs which define free ends of the expandable truss structure, 10 stems each having a coupler 3a or 3b secured to one end thereof, each pair of adjacent stems 10 being disposed in such a manner that their axes extend in opposite directions. The numeral 11 denotes a main slide hinge which slides on each stem 10, and 12 ribs pinned at first ends thereof to the main slide hinge 11 so as to extend radially therefrom, the ribs 12 being deployable at right angles to the axis of the stem 10, and the second end of each rib 12 being pinned to a coupler 3b which is secured to an adjacent inverted stem 10 in inverse relation to the coupler 3a on said stem 10. Those ends of the ribs 12 which define free ends of the expandable truss structure are connected to the second couplers 3c, respectively.

The numeral 13 denotes wires which are disposed between the couplers 3a, 3b secured to the ends of the stems 10, between the second couplers 3c disposed at the free ends of the expandable truss structure and between the first couplers 3a which are disposed at the peripheral portion of the structure and the second couplers 3c, the wires 13 being set so that they are pulled when the expandable truss structure is deployed.

Figure 17:
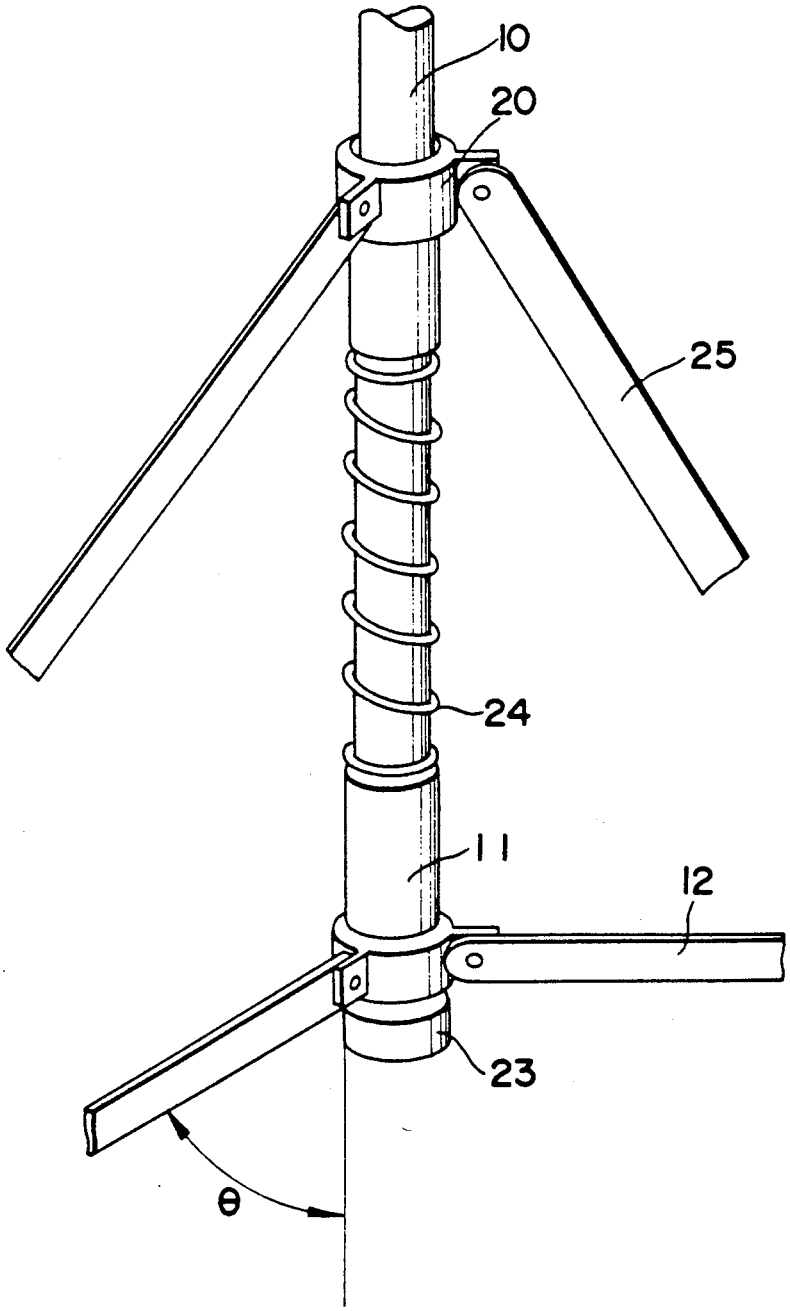
FIG. 17 shows the joints of the members in the fourth embodiment of the present invention.

Reference numeral 22 denotes diagonal members connecting together the couplers 3a on the top surface side and the couplers 3b, 3c on the bottom surface side by means of pins, 20 a synchronous slide hinge which slides on each stem 10 between the coupler 3 and the main slide hinge 11 and 25 a synchronous beam which is pinned at one end thereof to the synchronous slide hinge 20 and at the other end to an intermediate portion of each rib 12. FIG. 17 is an enlarged view of the portion C of FIG. 16, in which reference numeral 23 denotes a stopper which defines the bottom dead centre point of the main slide hinge 11 when the structure is deployed, 24 a coil spring which provides driving force for deploying the expandable truss structure according to the present invention, and $\theta$ is the angle between the stem 11 and each rib 12, the angle $\theta$ being set so as to be about 90° when the expandable truss structure is deployed.

Deployment of the expandable truss structure according to the fourth embodiment of the present invention arranged as detailed above will next be explained.

When this expandable truss structure is in a packaged state, the triangle which is defined by the following three vertices when the structure is deployed, i.e., a coupler on a stem 10, for example, a coupler 3*a*, the main slide hinge 11 on the stem 10 and another coupler, for example, a coupler 3*b*, connected to the second end of a rib 12 which is pinned at its first end to the main slide hinge 11, is deformed, and the angle $\theta$ between the rib 12 and the stem 10 shown in FIG. 17 is zero. Deployment is effected by pushing the main slide hinge 11 and the synchronous slide hinges 20 away from each other by means of the resilient force of the coil spring 24. As the distance from the main slide hinge 11 to the synchronous slide hinge 20 increases, the distance from the coupler 3*a* on the stem 10 to the main slide hinge 11 also increases. However, the distance from the coupler 3*a* to the coupler 3*b* is maintained at a predetermined length by means of the diagonal member 22. Since the distance from the coupler 3*b* to the main slide hinge 11 is also maintained at an amount equivalent to the length of the rib 12, the triangle that is defined by the above-described three vertices is deployed, and the angle $\theta$ between the rib 12 and the stem 10 increases. As a result, the distance from the coupler 3*b* to a still further coupler, for example, a coupler 3*c*, which is provided at the second end of another rib 12 which is pinned at its first end to the above-described main slide hinge 11 also increases. When the main slide hinge 11 comes near the stopper 23, the wires 13 extending between the couplers 3*a* on the top surface side, between the couplers 3*b*, 3*c* on the bottom surface side and between the couplers 3*a* at the free ends of the top surface and the couplers 3*c* at the free ends of the bottom surface are tensely stretched. The wires 13 are continuously stretched out until the main slide hinge 11 abuts against the stopper 23. Since the wires 13 thus stretched cause the couplers 3*a*, 3*b* and 3*c* to be pressed toward the ribs 12, there is no looseness at the pin joints, and the expandable truss structure hence becomes highly rigid.

Figure 18:
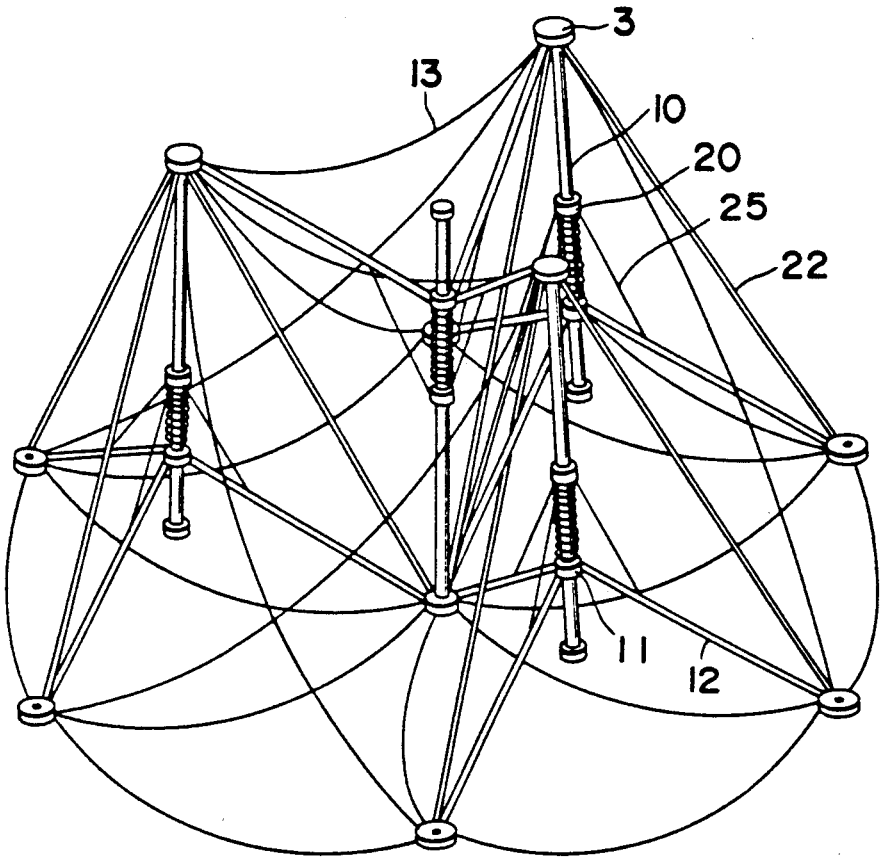
FIG. 18 shows the fourth embodiment of the present invention as deployed.

FIG. 18 shows the expandable truss structure according to the fourth embodiment of the present invention as deployed.

Thus, according to the fourth embodiment of the present invention, it is possible to obtain high rigidity with ease since the wires are stretched between the vertices of each tetrahedral module to construct a rigid structure which is free from looseness.

In the fourth embodiment of the present invention, synchronous beams for effecting synchronous deployment and a coil spring for supplying energy for deployment are incorporated between each stem and the associated ribs. Therefore, reliability in deployment is enhanced and deployment is attained without the aid of external force.

Figure 19:
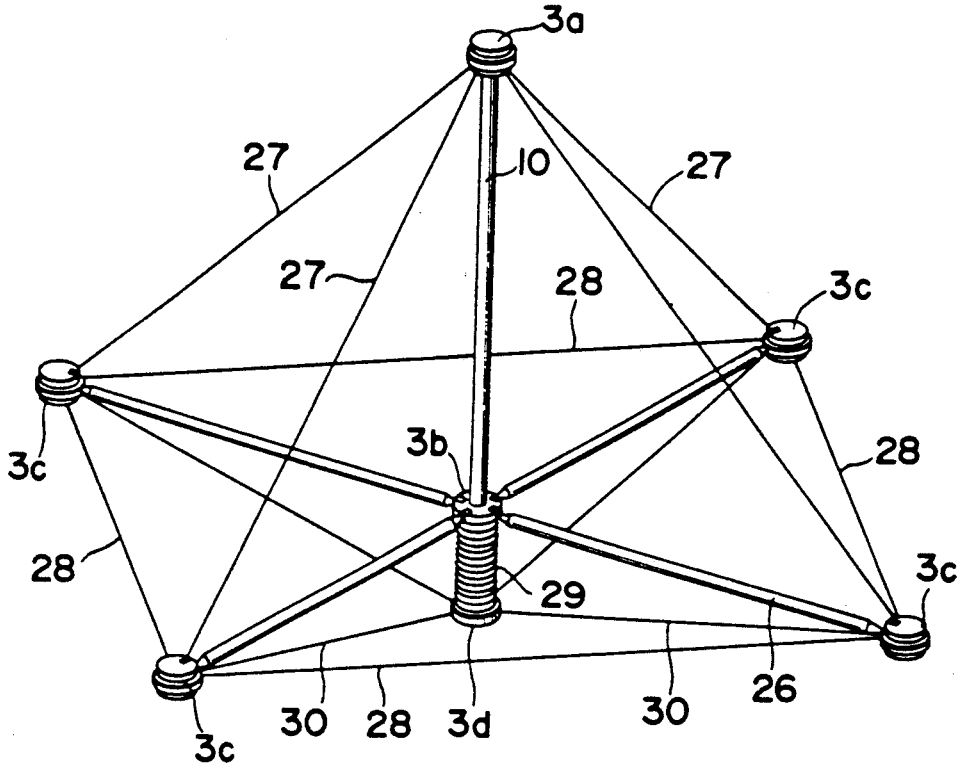
FIG. 19 schematically shows a basic module of an expandable truss structure according to a fifth embodiment of the present invention.

FIG. 19 shows a basic module of an expandable truss structure according to a fifth embodiment of the present invention, the module being in a deployed state. In the figure, reference numerals 3*a*, 3*b* and 3*c* respectively denote first, second and third couplers each having a joint portion, 3*d* a fourth coupler, 10 a stem having the first and second couplers 3*a*, 3*b* secured to both ends thereof, and 26 four ribs having the same length, each rib 26 being pinned at both ends thereof to second and third couplers 3*b*, 3*c*, respectively, and deployable in a direction perpendicular to the axis of the stem 10 when the expandable truss structure is deployed. The numeral 27 denotes first tension members having the same length which are tensely stretched between the first and third couplers 3*a*, 3*c* when the structure is deployed, 28 second tension members having the same length each of which is tensely stretched between each pair of adjacent third couplers 3*c* when the structure is deployed, 29 a spring having both ends thereof connected to the second and fourth couplers 3*b*, 3*d*, and 30 third tension members having the same length which are tensely stretched between the third and fourth couplers 3*c*, 3*d* when the structure is deployed. Thus, the force of the spring 29 is transmitted to the various members through the third tension members 30 to apply deploying force to the basic unit of the expandable truss structure. Further, when the structure is in a deployed state, compressive force is imposed on the joints of the stem 10 and the ribs 26 by applying tension to the first and second tension members 27, 28, thereby eliminating looseness from the pin joint portion of each coupler 3.

Figure 20:
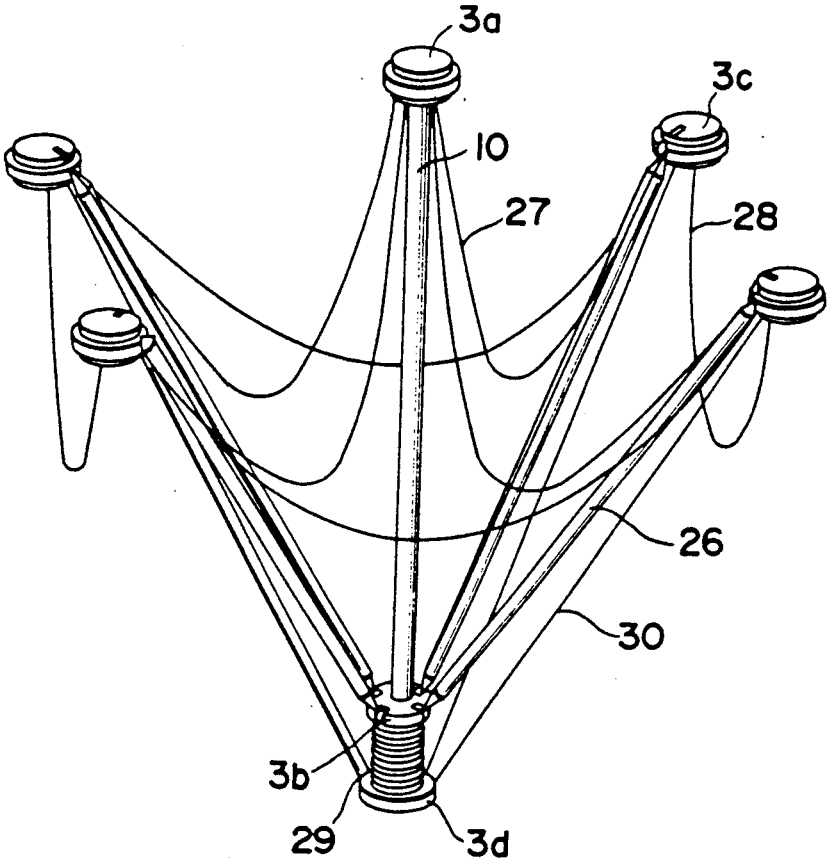
FIG. 20 schematically shows the basic module shown in FIG. 19 as deployed.

FIG. 20 shows the above-described basic module of a expandable truss structure as deployed. In this state, the first and second tension members 27, 28 that have flexibility are not tense but bend under their own weight.

Figure 21:
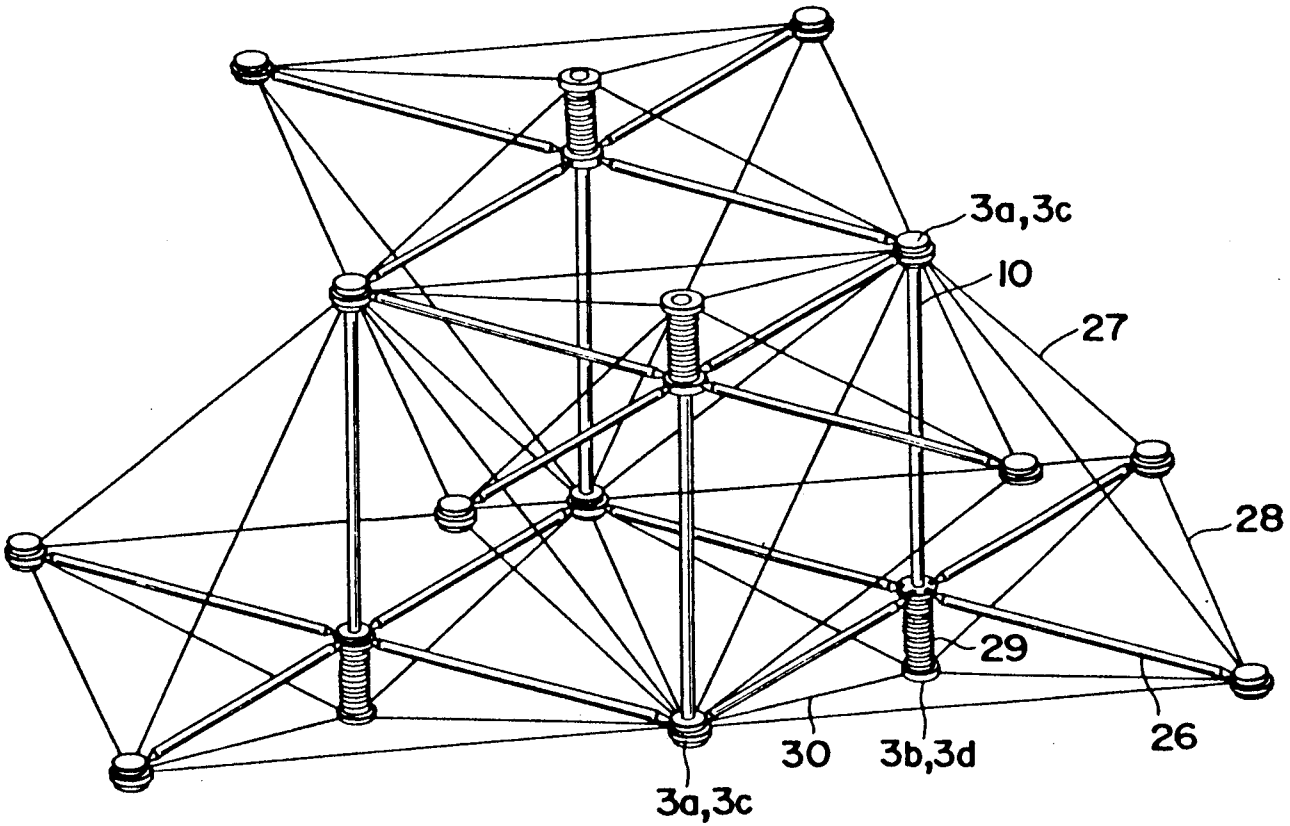
FIG. 21 schematically shows an expandable truss structure in a deployed state which is formed by combining together a plurality of basic modules of the type shown in FIG. 19.

FIG. 21 shows an expandable truss structure formed by combining a plurality of basic modules of the type described above, the structure being in a deployed state. In each pair of adjacent basic modules which have their respective stems 10 extending in opposite directions, these modules are connected together by sharing one first tension member 27 in such a manner that the first coupler 3*a* of one of the modules defines one of the third couplers 3*c* of the other. In each pair of adjacent basic modules which have their respective stems 10 extending in the same direction, these modules are connected together in such a manner as to share two third couplers 3*c* and one second tension member 28. In this way, an expandable truss structure which can be deployed in a planar configuration is formed. In FIG. 21, the first and third couplers 3*a*, 3*c* are identical with each other.

Deployment of the expandable truss structure according to the fifth embodiment of the present invention will next be explained.

In a completely packaged state, the stem 10 and the ribs 26 of the basic module of an expandable truss structure are closer to each other than in the state shown in FIG. 20, the angle made therebetween being substantially zero, and the spring 29 is in its maximum compressed state. Thus, the ribs 29 are biased so as to be deployed by the force of the spring 29 which is transmitted thereto through the third tension members 30 and the third couplers 3*c*. In the expandable truss structure shown in FIG. 21, each pair of adjacent basic modules which are in the packaged state are disposed in such a manner that their respective stems 10 extend in opposite directions. In the packaged state, the height of the truss structure in the axial direction of the stem 10 is the sum total of heights of the stem 10 and the spring 29. When the packaged truss structure which is restrained by an external means (not shown) is released, the deploying force supplied by the spring 29 causes the ribs 26 to pivot so as to extend radially in a direction perpendicular to the axis of the stem 10, so that the angle between the stem 10 and each rib 26 becomes substantially 90°. Thus, the tension applied to the first and second tension members the compressive force applied to the stem 10 and the ribs 26, the tension applied to the third tension members and the spring force equilibrate each other and, in this state, the deployed configuration of the structure is maintained. As described above, after the expandable truss structure has been deployed, tension or compressive force is applied to each member to eliminate looseness from the pin joint portion of each coupler, and equilibrium of forces is attained. Accordingly, it is possible to obtain a highly stable and rigid expandable truss structure.

Thus, according to the fifth embodiment of the present invention, it is possible to obtain high rigidity with ease since a tension member is tensely stretched between each pair of adjacent vertices o each polyhedral module to achieve a structure having no looseness. In addition, since a spring or the like is incorporated as the source of the energy utilized in deployment, the module is deployable without the aid of any external force.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A module for an expandable truss structure which defines one unit of said structure and which is capable of being transformed from a folded state to a deployed state, said module comprising:

a stem having first and second ends;

a first coupler secured to said first end of said stem;

a slide hinge slidably mounted on said stem, said slide hinge being movable in an axial direction of said stem;

at least three ribs each pinned at a first end thereof to said slide hinge, said ribs being deployable radially about the axial direction of said stem and having a second end;

a second coupler pinned to the second end of each of said ribs;

slide hinge stop means for stopping said slide hinge at a predetermined position on said stem when said module is deployed;

an intermediate member connecting said first coupler and each of said second couplers, said intermediate member having a length sufficient to stop the corresponding rib so that the corresponding rib extends substantially at right angles to said stem when said module is deployed;

a tension member provided between each pair of adjacent second couplers in such a manner that said tension member is tensely stretched between said pair of adjacent second couplers when said module is deployed;

at least one of said second couplers having a second stem extending therefrom parallel to said stem.

2. A module for expandable truss structure according to claim 1, wherein said tension member is a flexible wire.

3. A module for an expandable truss structure according to claim 40, wherein said slide hinge stop and lock means comprises a lock pin mounted on said stem at a position where said slide hinge is to be stopped, a pin groove for engagement with said lock pin, said pin groove being formed in said slide hinge, and a stopper mounted on the second end of said stem in such a manner that said slide hinge abuts against said stopper.

4. A module for an expandable truss structure according to claim 1 or 2 wherein said slide hinge stop means comprises slide hinge stop and lock means for locking said slide hinge at a predetermined position on said stem when said module is deployed.

5. A module for an expandable truss structure according to one of claims 1 or 2, further comprising:

a spring mounted on said stem to bias said ribs in the direction in which they are deployed.

6. A module for an expandable truss structure according to claim 4, further comprising:

a synchronous slide hinge mounted on said stem between said first end and said slide hinge, said synchronous slide hinge being movable in the axial direction of said stem;

a compression spring interposed between said synchronous slide hinge and said slide hinge for applying deploying force to said ribs; and a synchronous member provided for each of said ribs, said synchronous member being pinned at a first end thereof to said synchronous slide hinge and at a second end thereof to the corresponding rib.

7. A module for an expandable truss structure according to claim 5, wherein said synchronous member is pinned at said second end thereof to each of said second couplers.

8. A module for an expandable truss structure according to claim 5, wherein said synchronous member is by a beam member.

9. A module for an expandable truss structure according to claim 5, wherein said synchronous member is a wire member.

10. An expandable truss structure according to claim 5 wherein said synchronous member is pinned at said second end thereof to a point on the corresponding rib intermediate said first and second ends of said rib.

11. An expandable truss structure composed of a plurality of adjacent expandable truss structure modules which are connected together, each of said modules comprising:

a stem having first and second ends;

a first coupler secured to said first end of said stem;

a slide hinge slidably mounted on said stem, said slide hinge being movable in an axial direction of said stem;

at least three ribs each pinned at a first end thereof to said slide hinge, said ribs being deployable radially about the axial direction of said stem;

a second coupler pinned to a second end of each of said ribs;

slide hinge stop means for stopping said slide hinge at a predetermined position on said stem when said module is deployed;

an intermediate member for connecting said first coupler and each of said second couplers, said intermediate member having a length sufficient to stop the corresponding rib so that the corresponding rib extends substantially at right angles to said stem when said module is deployed; and a tension member provided between each pair of adjacent second couplers in such a manner that said tension member is tensely stretched between said pair of adjacent second couplers when said module is deployed, wherein each pair of adjacent modules have their respective stems extending parallel to each other in opposite directions, said first coupler of one of said pair of modules also serving as one of said second couplers of the other module.

12. An expandable truss structure according to claim 9, wherein said tension member is a flexible wire.

13. An expandable truss structure according to claim 9 or 10, wherein said slide hinge stop means comprises slide hinge stop and lock means for locking said slide hinge at a predetermined position on said stem when said module is deployed.

14. An expandable truss structure according to claim 13, wherein said slide hinge stop and lock means comprises a lock pin mounted on said stem at a position where said slide hinge is to be stopped, a pin groove for engagement with said lock pin, said pin groove being formed in said slide hinge, and a stopper mounted on said second end of said stem in such a manner that said slide hinge abuts against said stopper.

15. An expandable truss structure according to one of claims 9 or 10 further comprising:

a spring mounted on said stem for biasing said ribs in a direction in which they are deployed.

16. An expandable truss structure according to claim 12, further comprising:

a synchronous slide hinge mounted on said stem between said first end and said slide hinge, said synchronous slide hinge being movable in the axial direction of said stem;

a compression spring interposed between said synchronous slide hinge and said slide hinge to apply deploying force to said ribs; and a synchronous member provided for each of said ribs, said synchronous member being pinned at a first end thereof to said synchronous slide hinge and at a second end thereto to the corresponding rib.

17. An expandable truss structure according to claim 13, wherein said synchronous member is pinned at said second end thereof to a point on the corresponding rib intermediate said first and second ends of said rib.

18. An expandable truss structure according to claim 13, wherein said synchronous member is a beam member.

19. An expandable truss structure according to claim 13, wherein said synchronous member is a wire member.

20. First and second modules for an expandable truss structure which define one unit of said structure and which are capable of being transformed from a folded state to a deployed state, each of said modules comprising:

a stem having first and second ends;

a first coupler secured to said first end of said stem;

a slide hinge slidably mounted on said stem, said slide hinge being movable in the axial direction of said stem;

three ribs each pinned at a first end thereof to said hinge, so that the ribs are deployable at regular intervals about said stem;

a second coupler pinned to a second end of each of said ribs;

slide hinge stop means for stopping said slide hinge at a position where said ribs each extend substantially at right angles to said stem when said module is deployed;

a flexible wire connecting said first coupler and each of said said second couplers, the flexible wire having a length sufficient to stop the corresponding rib so that the corresponding rib extends substantially at right angles to said stem when said modules are deployed; and a flexible wire between each pair of adjacent second couplers in such a manner that the flexible wire is tensely stretched between said pair of adjacent second couplers when said modules are deployed, wherein said modules are coupled in such a manner that said first coupler of said first module serves as one of said second couplers of said second module, and one of said flexible wires for connecting said first and second couplers of said first module serves as one of said flexible wires for connecting said first and second couplers of said second module, so that said modules have their respective stems extending parallel to each other and in opposite directions.

21. A module for an expandable truss structure according to claim 20, wherein said slide hinge stop means comprises a lock pin mounted on said stem at a position where said slide hinge is to be stopped, a pin groove for engagement with said lock pin, said pin groove being formed in said slide hinge, and a stopper mounted on said second end of said stem in such a manner that said slide hinge abuts against said stopper.

22. A module for an expandable truss structure according to claim 20, further comprising:

a spring mounted on said stem to bias said ribs in a direction in which they are deployed.

23. A module for an expandable truss structure according to claim 20 or 21, further comprising:

a synchronous slide hinge mounted on said stem between said first end and said slide hinge, said synchronous slide hinge being movable in the axial direction of said stem;

a compression spring interposed between said synchronous slide hinge and said slide hinge for applying deploying force to said ribs; and a synchronous beam provided for each of said ribs, said synchronous beam being pinned at a first thereof to said synchronous slide hinge and at the second end thereof to the corresponding rib.

24. A module for an expandable truss structure according to claim 21, wherein said synchronous beam is pinned at the second end thereof to each of said second couplers.

25. A module for an expandable truss structure according to claim 21, wherein said synchronous member is a beam member.

26. A module for an expandable truss structure according to claim 21, wherein said synchronous member is a wire member.

27. A module for an expandable truss structure according to claim 21, wherein said synchronous beam is pinned at the second end thereof to a point on the corresponding rib intermediate said first and second ends of said rib.

28. An expandable truss structure composed of a plurality of expandable truss structure modules which are connected together, each of said modules comprising:

a stem having first and second ends;

a first coupler secured to said first end of said stem;

a slide hinge slidably mounted on said stem, said slide hinge being movable in an axial direction of said stem;

three ribs each pinned at a first end thereof to said hinge, so that the ribs are deployable at regular intervals about said stems;

a second coupler pinned to a second end of each of said ribs;

slide hinge stop means for stopping said slide hinge at a position where said ribs each extend substantially at right angles to said stem when said module is deployed;

a flexible wire for connecting said first coupler and each of said second couplers, the flexible wire having a length sufficient to stop the corresponding rib so that the corresponding rib extends substantially at right angles to said stem when said module is deployed; and a flexible wire provided between each pair of said adjacent second couplers in such a manner that the flexible wire is tensely stretched between said pair of second couplers when said module is deployed;

wherein first and second of said modules adjacent to each other are respectively connected in such a manner that said first coupler of said first module also serves as one of said second couplers of said second module, and one of said flexible wires for connecting said first and second couplers of said first module serves as one of said flexible wires for connecting said first and second couplers of said second module, so that said modules have their respective stems extending parallel to each other in opposite directions.

29. An expandable truss structure according to claim 28, wherein said slide hinge stop means comprises a lock pin mounted on said stem at a position where said slide hinge is to be stopped, a pin groove for engagement with said lock pin, said pin groove being formed in said slide hinge, and a stopper mounted on said second end of said stem in such a manner that said slide hinge abuts against said stopper.

30. An expandable truss structure according to claim 28, further comprising a spring mounted on said stem for biasing said ribs in a direction in which they are deployed.

31. An expandable truss structure according to claim 28 or 29, further comprising:

a synchronous slide hinge mounted on said stem between said first end and said slide hinge, said synchronous slide hinge being movable in the axial direction of said stem;

a compression spring interposed between said synchronous slide hinge to apply deploying force to said ribs; and a synchronous beam provided for each of said ribs, said synchronous beam being pinned at a first end thereof to said synchronous slide hinge and at a second end thereof to the corresponding rib.

32. An expandable truss structure according to claim 31, wherein said synchronous member is pinned at said second end thereof to each of said second couplers.

33. An expandable truss structure according to claim 31, wherein said synchronous member is a beam member.

34. An expandable truss structure according to claim 31, wherein said synchronous member is a wire member.

35. An expandable truss structure according to claim 31, wherein said synchronous member is pinned at said second end thereof to a point on the corresponding rib intermediate said first and second ends of said rib.

* * * * *